US006224059B1

(12) United States Patent
Sun

(10) Patent No.: US 6,224,059 B1
(45) Date of Patent: May 1, 2001

(54) CONTROLLED CONTACT PRESSURE FOR SCROLL COMPRESSOR SEAL

(75) Inventor: Zili Sun, Arkadelphia, AR (US)

(73) Assignee: Scroll Technologies, Arkadelphia, AK (US)

( * ) Notice: Subject to any disclaimer, the term of this patent is extended or adjusted under 35 U.S.C. 154(b) by 0 days.

(21) Appl. No.: 09/356,093

(22) Filed: Jul. 16, 1999

(51) Int. Cl.[7] ..... F16J 15/34; F16J 15/38

(52) U.S. Cl. ..... 277/364; 277/390; 277/399; 418/55.4

(58) Field of Search ..... 277/361, 364, 277/390, 396, 399, 406, 589; 418/55.4

(56) References Cited

U.S. PATENT DOCUMENTS 4,555,244 * 11/1985 Hazaki ..... 418/55.4
4,600,369 * 7/1986 Blain ..... 418/55.4
4,645,437 * 2/1987 Sakashita et al. ..... 277/217
4,743,181 * 5/1988 Murayama et al. ..... 418/57
4,993,928 * 2/1991 Fraser, Jr. ..... 418/55.4
5,040,956 * 8/1991 Barito et al. ..... 418/55.4
5,462,419 * 10/1995 Hill et al. ..... 418/55.4
5,588,820 * 12/1996 Hill et al. ..... 418/55.4
5,593,295 * 1/1997 Hill ..... 418/55.4
5,848,883 * 12/1998 Tsubokawa ..... 418/55.4
6,062,834 * 5/2000 Masumoto et al. ..... 418/55.4
6,077,057 * 6/2000 Hugenroth et al. ..... 418/55.4
6,086,342 * 7/2000 Utter ..... 418/55.5

* cited by examiner

*Primary Examiner*—Anthony Knight
*Assistant Examiner*—Vishal Patel
(74) *Attorney, Agent, or Firm*—Carlson, Gaskey & Olds

(57) ABSTRACT

An improved seal for defining a back pressure chamber in a scroll compressor includes a tab extending toward the rear face of the orbiting scroll. The tab reduces the contact force created against the rear face of the orbiting scroll by the gas pressure in the back pressure chamber. Thus, the inventive seal increases seal life.

15 Claims, 3 Drawing Sheets

CONTROLLED CONTACT PRESSURE FOR SCROLL COMPRESSOR SEAL

BACKGROUND OF THE INVENTION

This invention relates to seals for defining a scroll compressor back pressure chamber wherein the contact pressure between the seal and the scroll member is reduced compared to the prior art.

Scroll compressors are widely utilized in refrigerant compression applications. In a scroll compressor, a pair of scroll members face each other. The two scroll members each have a base with a generally spiral wrap extending from the base. The two spiral wraps interfit to define compression chambers. One scroll member is driven to orbit relative to the other. As the one scroll member orbits relative to the other, the intermitting spiral wraps move and decrease the volume of the compression chambers. In this way, refrigerant is compressed.

While scroll compressors do have several advantages, they also raise many design challenges. As an example, a separating force is created between the two scroll members as the refrigerant is compressed. The separating force tends to move the two scroll members away from each other. This reduces sealing contact between the two scroll members and leads to efficiency losses.

To address the separating force, scroll compressor designers create a "back pressure" chamber behind one of the two scroll members. Compressed fluid is tapped to the back pressure chamber and creates a force which opposes the separating force. The back pressure chamber is defined behind the base of one of the two scroll members by inner and outer sealing surfaces.

In one type of scroll compressor, the back pressure chamber is defined behind the orbiting scroll member, and includes two separate seals, with one at a radially inner position and one at a radially outer position. Pressurized refrigerant is tapped to a chamber defined between the two seals and creates the back pressure force.

In another type scroll compressor, the back pressure chamber is defined behind the non-orbiting scroll, and a single large seal with two sealing areas is utilized. The present invention has more benefit to the first type scroll compressor; however, aspects of the present invention may also prove beneficial to the second type scroll compressor.

The first type scroll compressor is shown in FIG. 1. A scroll compressor 20 incorporates a crankcase 22 receiving an orbiting scroll member 24. A pair of seals 26 and 28 define a back pressure chamber 30. A fixed scroll member 32 is positioned opposed to the orbiting scroll member. While the present invention is shown with the back pressure chamber defined behind the orbiting scroll 24, it should be understood that aspects of this invention might also apply to scroll compressors having the back pressure chamber defined behind the fixed, or non-orbiting scroll member. Further, while a pair of seals are shown, aspects of this invention might apply to scroll compressors having a single large seal.

As shown in FIG. 2A, seals 26 and 28 include a seal jacket 30 having a rear wall 32, and inwardly extending lips 34 and 36. A coil spring 38 is positioned in each seal jacket. The seal portions 34 abut a rear surface 40 of the orbiting scroll member 24. The spring 38 tends to bias the lip 34 into contact with the scroll member rear surface 40.

A gas pressure force on the seal jacket 34 also forces the seal jacket 34 into rear surface 40, in addition to the coil spring 38. As shown in FIG. 2B, inward of lips 34 and 36, the lips see the full pressure P in the back pressure chamber 30. However, outwardly of the lips 34 and 36, there is a restriction against flow. Thus, there is a pressure gradient from P downwardly toward a lower pressure. As shown in FIG. 2C, there is a gradient of the contact force between the lip 34 and 36 and the rear surface 40 of scroll member 24 which is generally reversed from the gradient shown in FIG. 2B. As shown, the force is very large adjacent the rear wall 32, and becomes smaller adjacent the inner edges of lips 34 and 36. Adjacent the inner edges of lips 34 and 36, the pressure outwardly of the lips is generally equal to the pressure inwardly, and thus the pressures are cancelled. However, due to the pressure gradient the contact force does become larger approaching the rear wall 32.

Thus, adjacent the rear wall 32, there is a contact force against the rear surface 40 which is undesirably high. Orbiting scroll 24 orbits relative to the seals. This contact force can lead to undue seal wear and premature seal failure.

SUMMARY OF THE INVENTION

In a disclosed embodiment of this invention, a seal for a scroll compressor back pressure chamber has a smaller contact area adjacent to the scroll member than is found adjacent to a housing member which receives the seal. In one preferred embodiment, this smaller force is provided by a thin sheet which includes a tab providing the contact area with the scroll member. Stated another way, there is structure on the seal for allowing pressurized gas in the back pressure chamber to move between the seal and the rear surface of the scroll member over the majority of the radial thickness of the seal surface. Stated yet another way, the seals each include an inner seal surface facing a housing and an outer seal surface facing the scroll member. The outer seal surface is provided with a tab extending for a portion of the radial thickness of the outer seal surface. The tab extends away from a lip surface of the outer seal surface and toward the scroll member, such that only the tab contacts the rear surface of the scroll member. The pressure in the back pressure chamber is communicated along the lip portion up to the tab portion.

In a most preferred embodiment, the invention is utilized in a scroll compressor having the back pressure chamber defined behind the orbiting scroll, and wherein generally U-shaped seal jackets are utilized in conjunction with a coil spring.

In embodiments of this invention, the tab may be formed at a position spaced inwardly of the rear wall, or alternatively may be generally aligned with the rear wall. In further embodiments, the sheet includes an extending lip which extends outwardly of the upper lip of the seal. The present invention also discloses an embodiment wherein a single seal sheet is associated with both the inner and outer seals that define the back pressure chamber. A pair of spaced ribs extend upwardly from the single sheet, and provide the smaller contact area.

With the present invention and its several embodiments, the use of the smaller contact area ensures that there is the full back pressure chamber P along the great majority of seal area. Thus, the force imbalance described above will not occur over as large an area. Instead, the force imbalance is generally cancelled, or at least controllable. In fact, the contact force between the seal and the scroll member from gas pressure can be eliminated. The contact force can be limited to a coil spring force, and the scroll compressor designer will have more control over this contact force.

These and other features of the present invention can be best understood from the following specification and drawings, the following of which is a brief description.

DETAILED DESCRIPTION OF A PREFERRED EMBODIMENT

Figure 1:
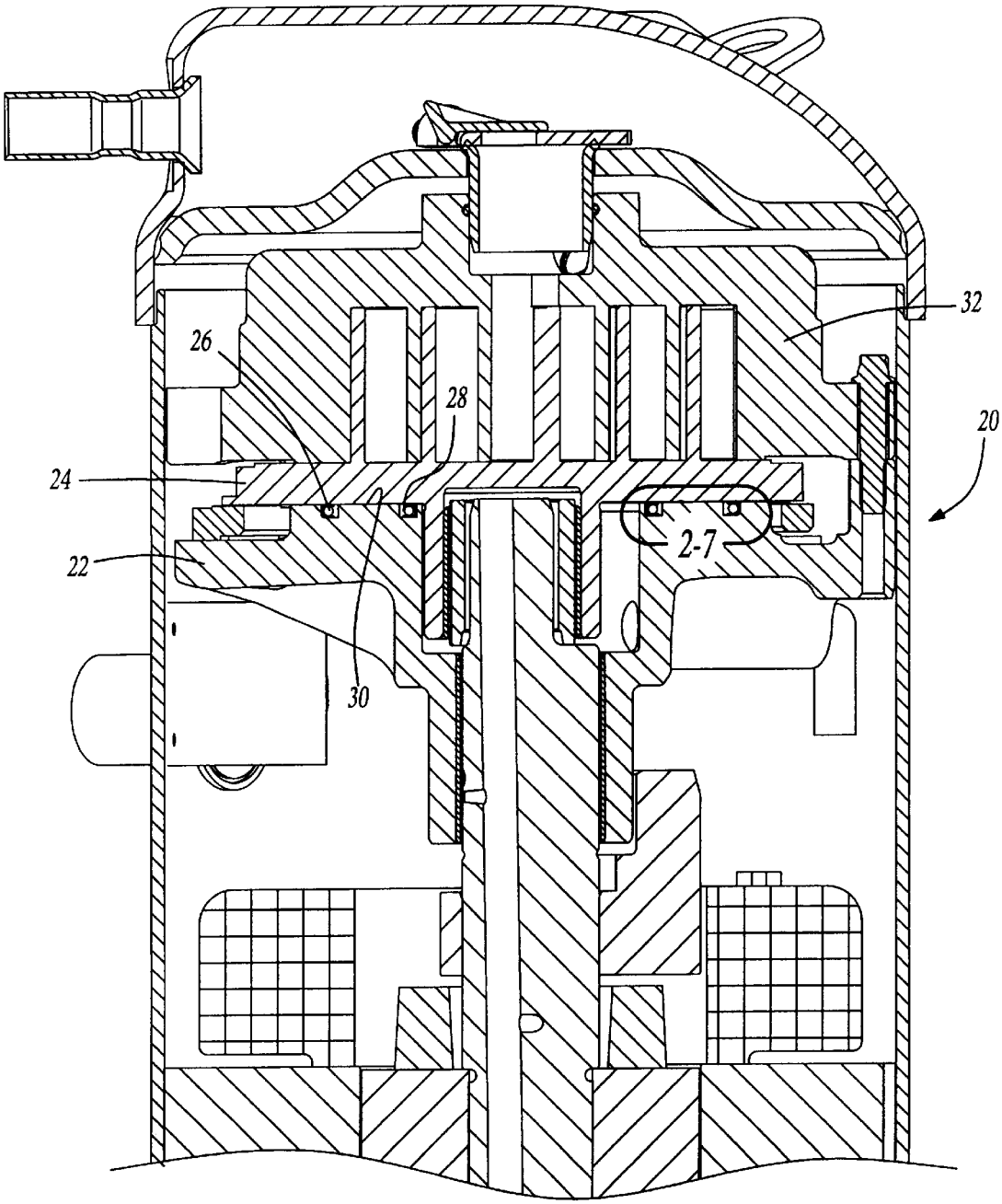
Fig-1 PRIOR ART
FIG. 1 shows a prior art scroll compressor.
Figure 2A:
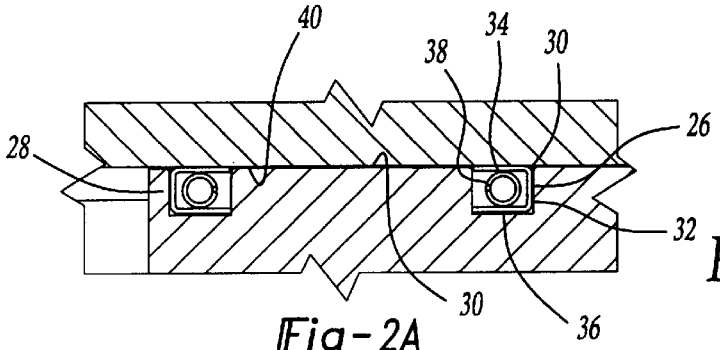
Fig-2A PRIOR ART
FIG. 2A shows the seals associated with the prior art scroll compressor.
Figure 2B:
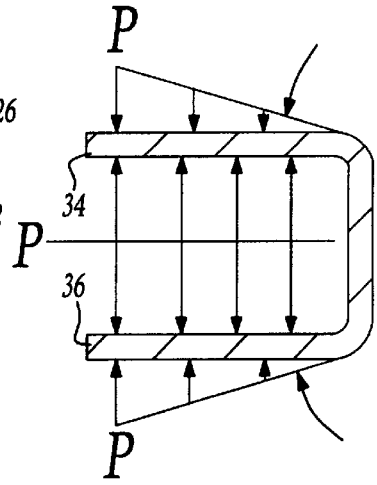
Fig-2B PRIOR ART
FIG. 2B shows a force diagram on the prior art seals.
Figure 2C:
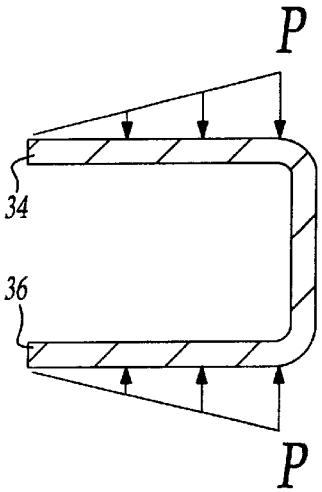
Fig-2C PRIOR ART
FIG. 2C shows a contact force diagram with the prior art seals.
Figure 3B:
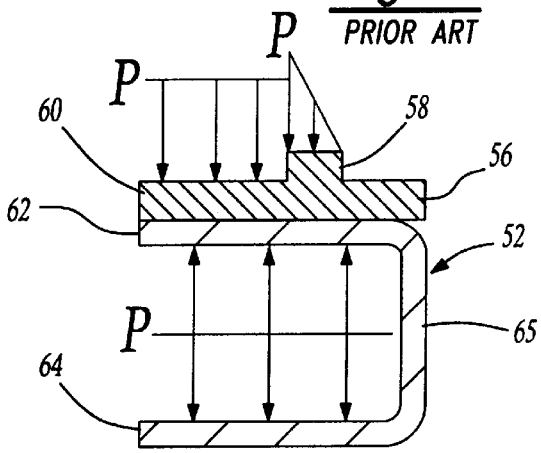
FIG. 3B shows the force diagram such as shown in FIG. 2B; however, with the FIG. 3A embodiment.
Figure 3A:
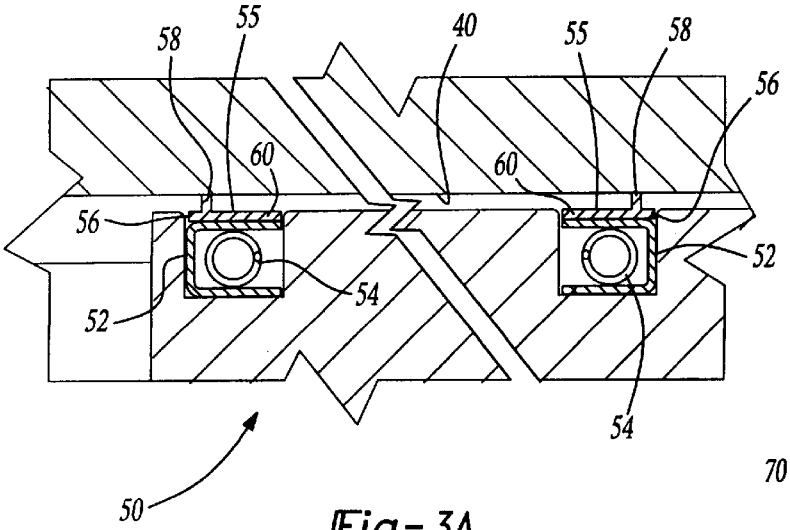
FIG. 3A shows a first embodiment seal according to the present invention.

FIG. 3A shows an inventive seal structure 50 for use in a scroll compressor. As shown, a seal jacket 52 is associated with both of the inner and outer seals. The seal further includes an inner coil spring 54. A sheet 55 is placed between the seal 52 and the rear surface 40 of the orbiting scroll. As mentioned above, although the present invention is specifically disclosed as being positioned between the orbiting scroll and the housing, and is specifically disclosed in a seal having two separate seals, benefits from the present invention may be applicable to scroll compressors wherein the seal is defined behind the non-orbiting scroll, and in scroll compressors wherein a single seal is utilized.

A tab 58 extends upwardly from a generally planar face 60 of sheet 55. Sheet 55 also has an outwardly extending surface 56.

As shown in FIG. 3B, the seal jacket 52 has upper lip 62, lower lip 64, and a rear wall 65. The seal jacket 52 is generally as shown in the prior art, above.

As shown, the pressure between the lip 62 and 64 is the back chamber pressure P. However, since the tab 58 is over a very limited area, the pressure gradient from the back pressure chamber P toward 0 is also over the very limited thickness of the tab 58. The pressure along the lip 60, toward the back pressure chamber from the tab 58, is still the full back pressure chamber P. This is true because there is no tight restriction between lip 60 and rear surface 40. There is an area outwardly of the tab 58 along surface 56 which is at a pressure that can be assumed to be effectively 0 for purposes of understanding this invention.

FIG. 3B shows one of the two seals illustrated in FIG. 3A, the radially outer seal. It should be understood that the inner seal has a very similar structure. However, the radial position of the lip, tab and area 56 is reversed such that the lip 60 faces radially outwardly.

While structure may be defined as "radially outward" of the tab, or "radially inward" of the tab, it should be understood that when applied to the inner seal, the direction would be opposed.

With the present invention, the force imbalance due to the pressure gradiation is greatly reduced when compared to the prior art. The force from the back pressure chamber pressure over the length of the lip 60 cancels out the great bulk of the force inwardly of the lip 62. Thus, the total contact force experienced between the seal and the rear surface 40 is greatly reduced when compared to the prior art.

Figure 4:
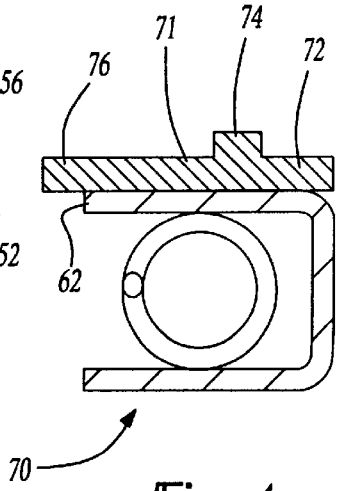
FIG. 4 shows a second embodiment seal.

FIG. 4 shows another embodiment 70 wherein the sheet 71 has an outer surface 72 spaced away from the back pressure chamber from the tab 74. The lip 76 extends radially beyond the innermost end of the lip 62.

Figure 5:
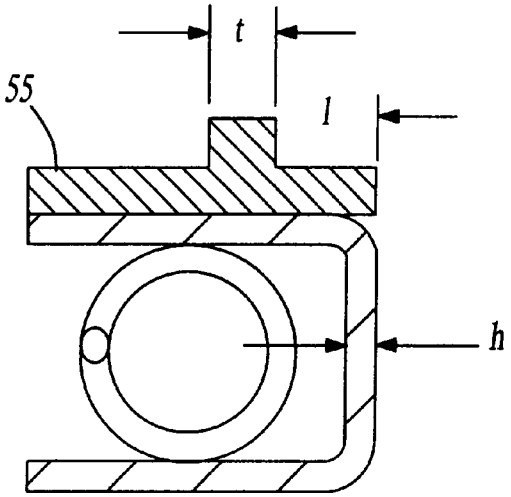
FIG. 5 shows a third embodiment seal.

FIG. 5 shows several dimensions which are relevant to the design of the inventive seal sleeve. As shown, the thickness of the rear wall can be defined by a dimension h. The thickness of the tab is defined by dimension t. The distance between the outer wall of the tab 58 and the end of the rear wall of the seal jacket is defined by the dimension 1. The designer can tailor these dimensions such that a particular contact force can be achieved while still achieving adequate sealing.

The scroll compressor designer can assume that the pressure over the lip 55 is effectively equal to the pressure between the seal jacket lips. Also the pressure across the tab through the dimension t will be on average P/2. The gradient goes from P to effectively 0 over the thickness of the tab. The pressure on the area through the thickness 1 will be effectively 0. The scroll compressor designer can then balance various desired design goals and achieve a final desired seal sheet dimension.

Figure 6:
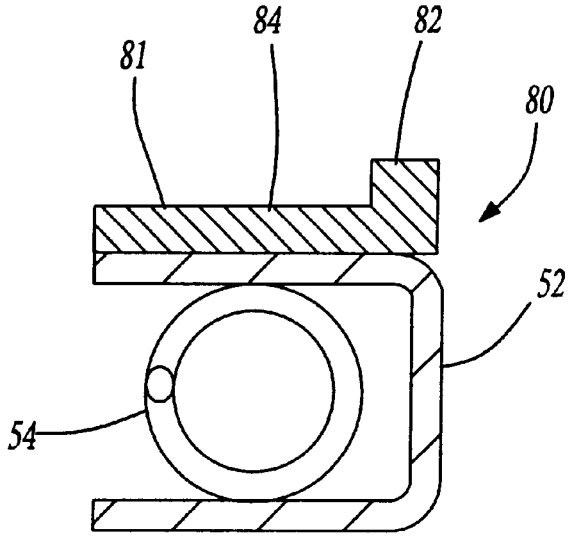
FIG. 6 shows a fourth embodiment seal.

FIG. 6 shows another embodiment 80 wherein the sheet 81 includes its tab 82 adjacent the edge of the sheet. The lip 84 extends over the remainder of the sheet 81. The thickness t is selected to be equal to generally twice the thickness h. The pressure on the lip 84 is equal to the pressure inwardly of the seal jacket. The pressure on the tab 82 can be approximated as P/2. However, since this pressure gradient occurs over a thickness that is twice the thickness of the rear wall 52, it is cancelled by the total force applied inwardly of the jacket for the dimension h forwardly of the rear wall. As such, the embodiment 80 completely cancels out the force from the back pressure chamber tending to bias the seal into contact with the orbiting scroll. The coil spring 54 thus provides the only contact force. The scroll compressor designer can thus tailor the desired force, and achieve a force that is as designed.

Figure 7:
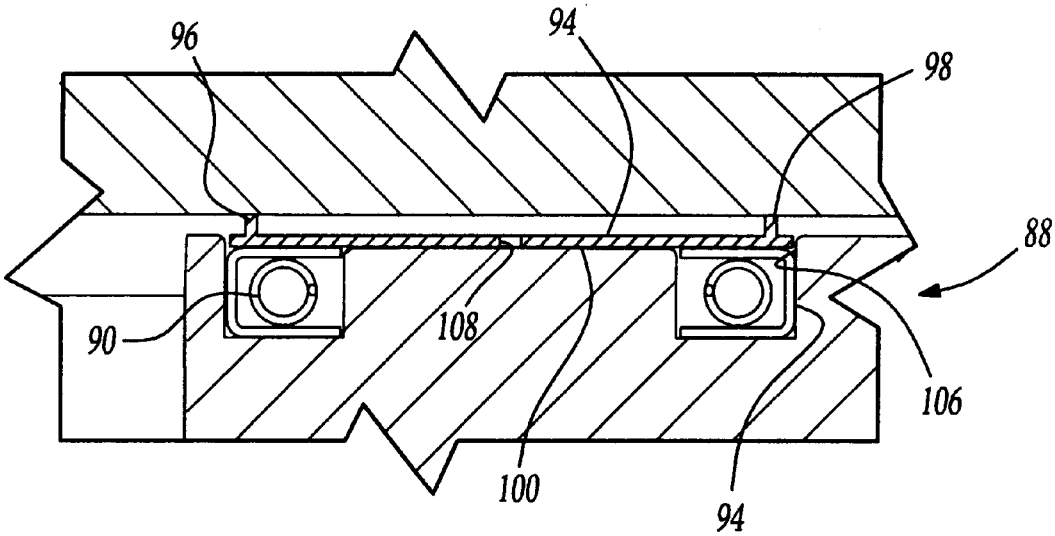
FIG. 7 shows a fifth embodiment seal.

FIG. 7 shows yet another embodiment 88, wherein the inner seal 90 and the outer seal 94 are both provided with a single sheet 94 having inner tab 96 and outer tab 98. A surface 100 extends between the two tabs 96 and 98. The location of the tabs may be adjacent the edges as shown in FIG. 6, rather than as shown in the FIG. 7. With this embodiment, the same benefits mentioned above will be achieved.

As shown, sheet 94 rests in a cylindrical recess 106 in the face of the crankcase. At least one vent 108 equalizes pressures on opposed sides of the sheet 94.

In summary, the present invention could be described in several different ways. In one way, the present invention reduces the contact area between the seal and the scroll member such that the contact area is smaller than the contact area between the seal and the opposed housing surface. Stated another way, the seals are provided with structure for allowing gas in the back pressure chamber to move between the seal and the rear surface of the scroll over the majority of the radial thickness of the seal. In this way, the full back pressure force is seen by the outer surface of the seal over the majority of its surface area. Finally, stated another way, the seals have an inner seal surface and an outer seal surface which faces the first scroll member. The outer seal surface can be defined as having a radial thickness. A tab is formed on the outer seal surface for a portion of the radial thickness. The tab extends away from a lip surface of the outer seal surface toward the scroll member, such that only the tab contacts the rear surface of the scroll member. The pressure in the back pressure chamber is thus communicated to the lip portion up to where the tab portion begins. Again, in this way, the overall contact force is reduced.

The present invention thus discloses improvements in scroll compressor back chamber seals. The inventive seals reduce the contact force, and improve seal life.

Several preferred embodiments of this invention have been disclosed. However, workers in this art would recognize that various modifications would come within the scope of this invention. Thus, the following claims should be studied to determine the true scope and content of this invention.

What is claimed is:

1. A scroll compressor comprising:

a first scroll member having a base and generally spiral wrap extending from said base;

a second scroll member having a base and a generally spiral wrap extending from said base, said generally spiral wraps of said first and second scroll members interfitting to define compression chambers, said first scroll member being driven to orbit relative to said second scroll member; and a housing member defined outwardly of said base of at least one of said first and second scroll members, said housing member supporting said one of said first and second scroll members, and said housing member defining a back pressure chamber between a rear surface of said at least one scroll member and said housing member, a pair of radially spaced seal surfaces received in said housing member for defining said back pressure chamber, said seal surfaces each having a surface in contact with said rear surface and structure on said seal surface for allowing gas pressure in said back pressure chamber to move between said seal surfaces and said rear surface over the majority of a radial thickness of said seal surface, said seal surfaces having a sealing contact surface in contact with said housing to provide a seal at a location such that said back pressure chamber gas pressure is allowed to flow over the majority of said radial thickness of said seal surfaces in a generally unrestricted manner.

2. A scroll compressor as recited in claim 1, wherein said at least one housing is a crankcase supporting said first scroll member, and said back pressure chamber being defined outwardly of said base plate of said first scroll member.

3. A scroll compressor as recited in claim 1, wherein said seal surfaces are provided by a pair of seals, each of said seals having said contact surface in contact with said first scroll member.

4. A scroll compressor comprising:

a first scroll member having a base and generally spiral wrap extending from said base;

a second scroll member having a base and a generally spiral wrap extending from said base, said generally spiral wraps of said first and second scroll members interfitting to define compression chambers, said first scroll member being driven to orbit relative to said second scroll member; and a back pressure chamber defined between the crankcase and said first scroll member, a pair of seals positioned in said crankcase to define said back pressure chamber, said seals each being in contact with a rear face of said first scroll member base, and in contact with said crankcase, and said seals having a tab extending toward said orbiting scroll, said tab extending for a relatively small radial dimension such that the area of said seal contact area in contact with said orbiting scroll is smaller than the surface area of said seal.

5. A scroll compressor as recited in claim 4, wherein said seal is U-shaped and receives an internal coil spring.

6. A scroll compressor as recited in claim 5, wherein said tab extends upwardly from a separate sheet, said sheet having a lip extending from said tab toward said back pressure chamber, and spaced away from said orbiting scroll base plate.

7. A scroll compressor as recited in claim 6, wherein said generally U-shaped seal has a rear wall connecting an inner and outer lip, and said tab being formed adjacent said rear wall.

8. A scroll compressor as recited in claim 7, wherein said rear wall has a radial thickness, and said tab having a radial thickness generally twice said radial thickness of said rear wall.

9. A scroll compressor as recited in claim 4, wherein a single sheet includes a pair of spaced tabs, with one of said tabs being associated with an inner seal and a second of said tabs being associated with an outer seal.

10. A scroll compressor comprising:

a first scroll member having a base and generally spiral wrap extending from said base;

a second scroll member having a base and a generally spiral wrap extending from said base, said generally spiral wraps of said first and second scroll members interfitting to define compression chambers, said first scroll member being driven to orbit relative to said second scroll member; and a back pressure chamber defined between the crankcase and said first scroll member, a pair of seals positioned in said crankcase to define said back pressure chamber, said seals each being in contact with a rear face of said first scroll member base, and in contact with said crankcase, and said seals having a tab extending toward said orbiting scroll, said seals each including an inner seal surface, and an outer seal surface facing a rear surface of said first scroll member, said outer seal surface having a radial thickness, and there being a tab portion on said outer seal surface for a portion of said radial thickness, said tab extending away from a lip surface of said outer seal surface toward said orbiting scroll member such that only said tab portion contacts said rear surface of said orbital scroll member, and the pressure in said back pressure chamber is communicated to said lip portion of said outer seal surface.

11. A scroll compressor as recited in claim 10, wherein said seal is U-shaped and receives an internal coil spring.

12. A scroll compressor as recited in claim 11, wherein said outer seal portion is provided by a separate sheet, said separate sheet being positioned between said u-shaped seal and said first scroll member.

13. A scroll compressor as recited in claim 12, wherein said generally U-shaped seal has a rear wall connecting an inner and outer lip, and said tab being forced adjacent said rear wall.

14. A scroll compressor as recited in claim 13, wherein said rear wall has a radial thickness, and said tab having a radial thickness generally twice said radial thickness of said rear wall.

15. A. scroll compressor as recited in claim 10, wherein a single sheet includes a pair of spaced tabs, with one of said tabs being associated with an inner seal and a second of said tabs being associated with an outer seal.

* * * * *